US009118996B1

(12) United States Patent
Garcia

(10) Patent No.: US 9,118,996 B1
(45) Date of Patent: Aug. 25, 2015

(54) HEAD BAND WITH WIRELESSLY ENGAGED MUSIC PLAYER

(71) Applicant: Miguel A. Garcia, San Francisco, CA (US)

(72) Inventor: Miguel A. Garcia, San Francisco, CA (US)

( * ) Notice: Subject to any disclaimer, the term of this patent is extended or adjusted under 35 U.S.C. 154(b) by 332 days.

(21) Appl. No.: 13/874,716

(22) Filed: May 1, 2013

(51) Int. Cl.
*H04R 1/10* (2006.01)

(52) U.S. Cl.
CPC ..... *H04R 1/1066* (2013.01)

(58) Field of Classification Search
CPC ..... H04R 5/033; H04R 1/1041
See application file for complete search history.

(56) References Cited

U.S. PATENT DOCUMENTS

| | | | | |
|---|---|---|---|---|
| D282,020 | S | 1/1986 | Gwon et al. | |
| 4,682,363 | A * | 7/1987 | Goldfarb et al. | 381/74 |
| 5,438,698 | A | 8/1995 | Burton et al. | |
| 2006/0185062 | A1 | 8/2006 | Peng et al. | |
| 2008/0144872 | A1 | 6/2008 | Phillips | |
| 2009/0208040 | A1 | 8/2009 | Planansky | |

* cited by examiner

*Primary Examiner* — Simon King

(57) ABSTRACT

The present invention features a headband system comprising a headband, an adaptor removably attached to the headband, a music player. The music player is removably attached to the adapter and is configured to wirelessly engage to the adapter and be controlled by a plurality of control buttons on the adaptor via Bluetooth connection. The music player may be attached to the adapter directly or be placed at proximity of the adaptor to play music using the control buttons on the adaptor.

4 Claims, 4 Drawing Sheets

HEAD BAND WITH WIRELESSLY ENGAGED MUSIC PLAYER

FIELD OF THE INVENTION

The present invention relates to a headband and more specifically to a headband with wirelessly engaged and removably attached music player.

BACKGROUND OF THE INVENTION

Headbands are clothing accessories worn in the hair or around the forehead. Headbands generally consist of a loop of elastic material to hold hair away from the face or eyes. Headbands are typically worn around the forehead during physical activities, such as jogging, to absorb sweat. Developments in modem electronic miniaturization technology have made it practical to incorporate compact music players, such as the iPod, into headbands without excessive weight addition to affect headband function. While some prior arts describes headband with means to hold music players, the music player can connected to headband via wire connection thus the functionality is limited. Therefore, there is a need for a headband with capacity of wirelessly engaging to a removably attached music player.

Any feature or combination features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a headband system comprising a headband, an adaptor removably attached to the headband, a music player. The music player is removably attached to the adapter and is configured to wirelessly engage to the adapter and be controlled by a plurality of control buttons on the adaptor via Bluetooth connection. The music player may be attached to the adapter directly or be placed at proximity of the adaptor to play music using the control buttons on the adaptor.

DESCRIPTION OF PREFERRED EMBODIMENTS

Figure 1:
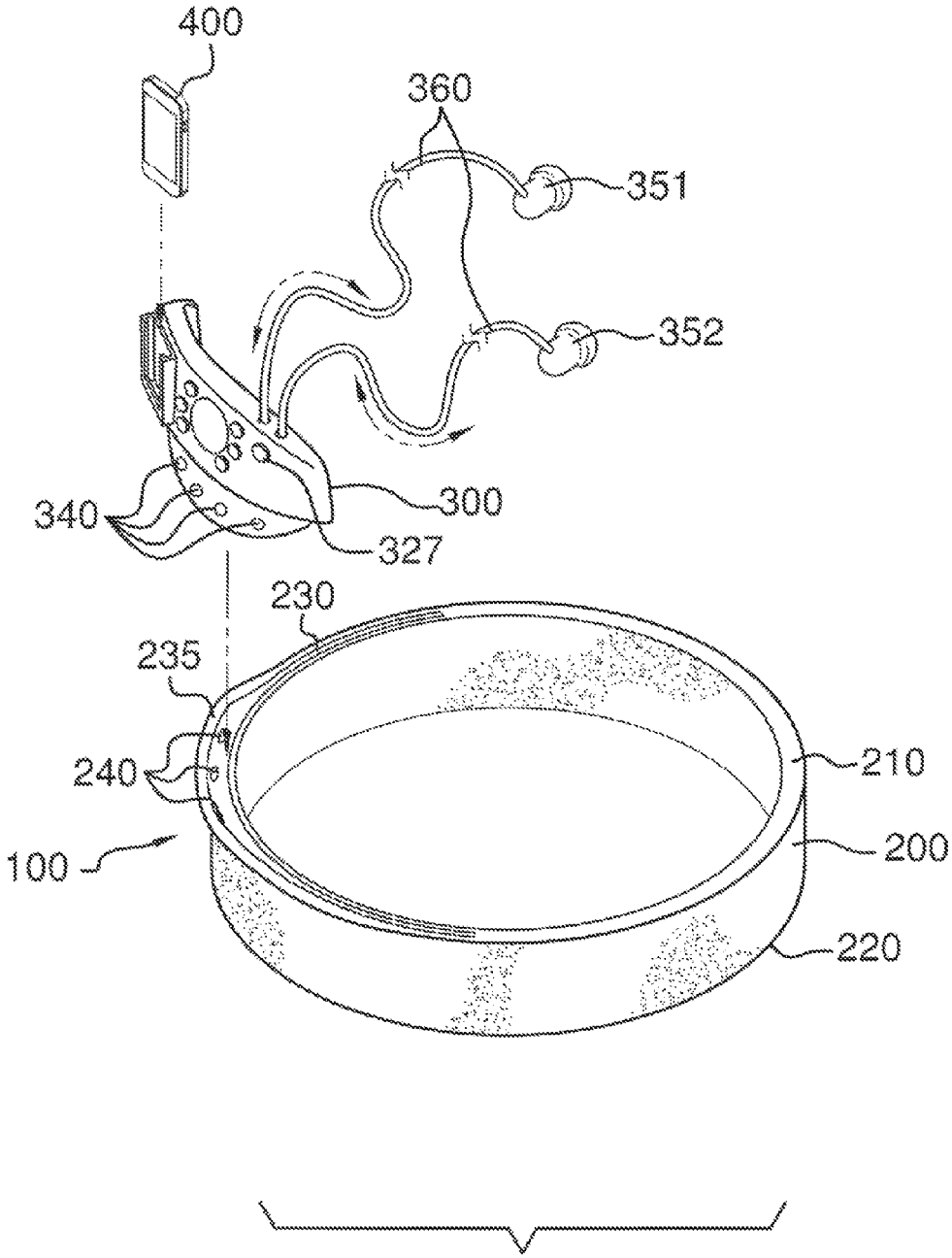
FIG. 1 shows a component view of the headband system. In some embodiments, the one or both of the earphone cords are retractable into the adaptor. The recoiling or retraction of the earphone cords may be accomplished via standard recoiling/retracting mechanisms as known by one of ordinary skill in the art, for example, automatic recoil systems based on spring spools are well known in the art.
Figure 2:
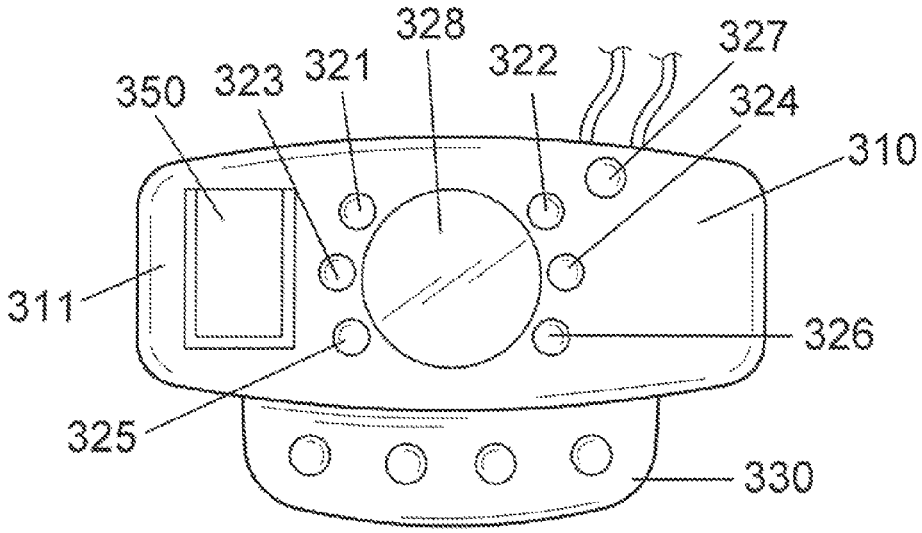
FIG. 2 shows a front view of the adaptor.
Figure 3:
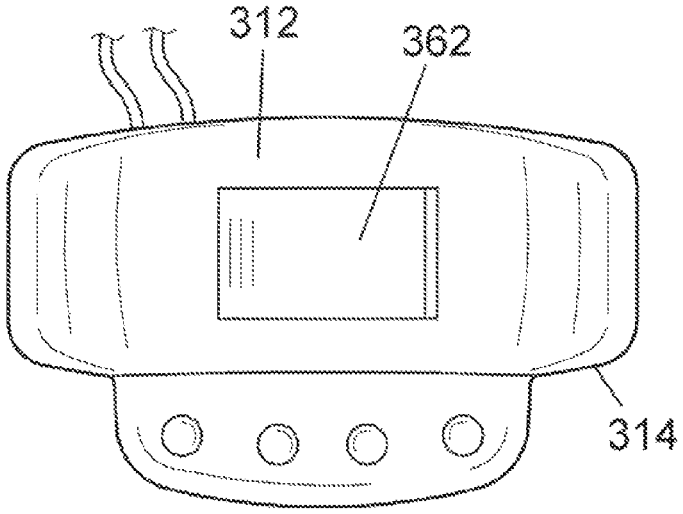
FIG. 3 shows a back view of the adaptor.
Figure 4:
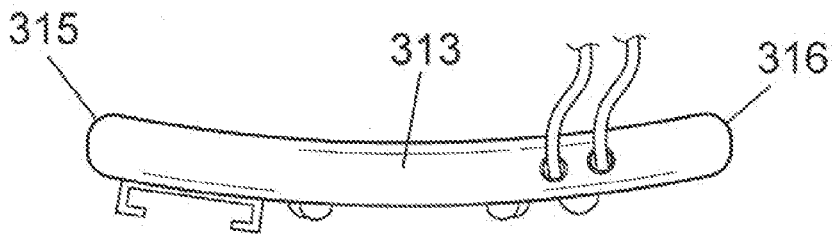
FIG. 4 shows a top view of the adaptor.
Figure 5:
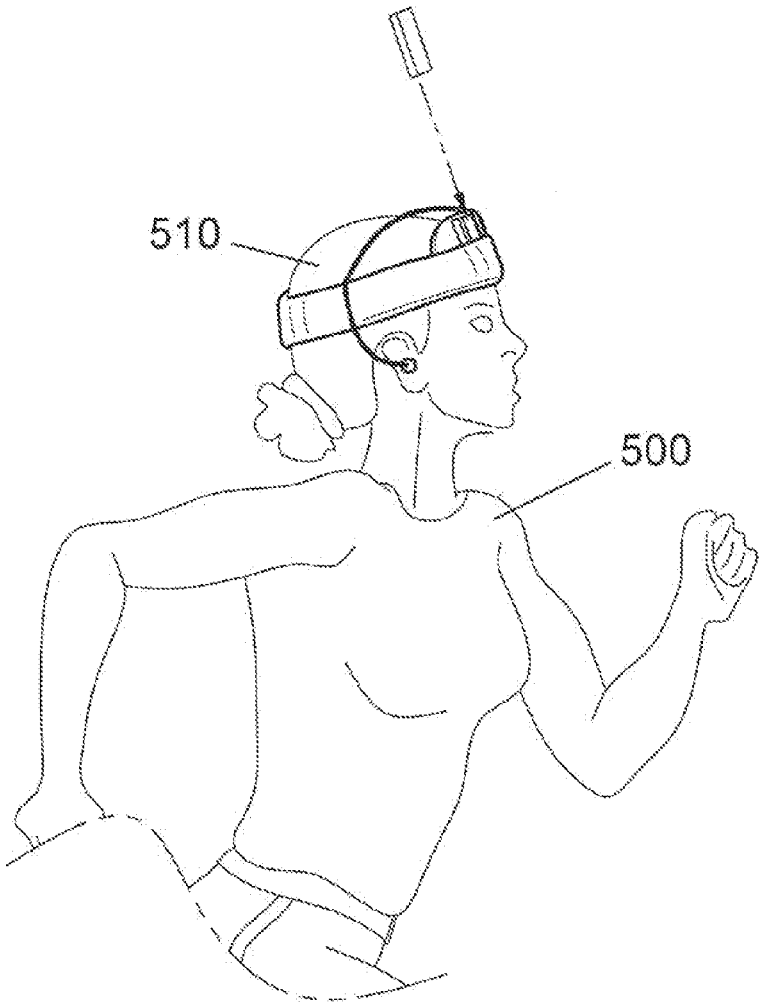
FIG. 5 shows an in-use view of the adaptor.
Figure 6:
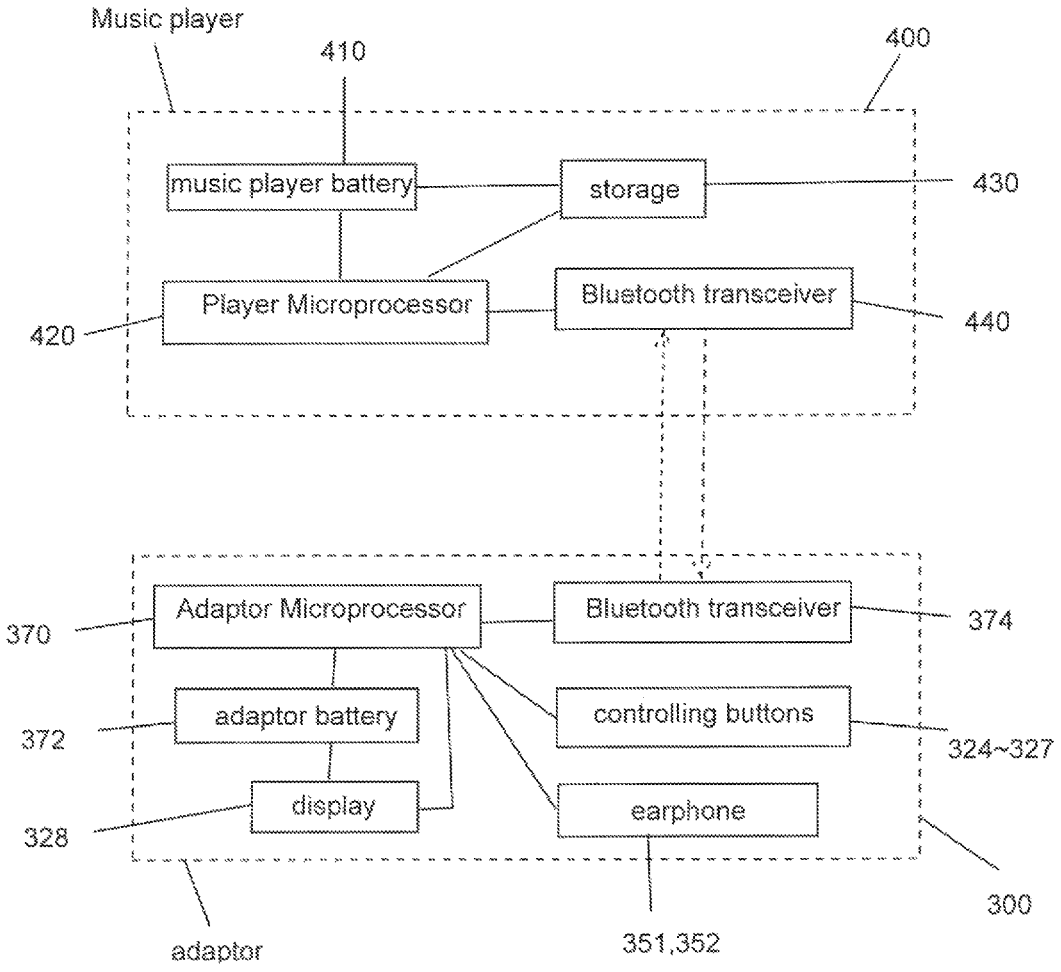
FIG. 6 shows a block diagram view of the headband system.

Following is a list of elements corresponding to a particular element referred to herein:

100 headband system
200 headband
210 top side of the headband
220 bottom side of the headband
230 curved slot on the top side
235 curved protrusion
240 holes
300 adaptor
310 main body of the adaptor
311 front side of the main body
312 back side of the main body
313 top side of the main body
314 bottom side of the main body
315 first side of the main body
316 second side of the main body
321 first control button
322 second control button
323 third control button
324 fourth control bottom
325 fifth control button
326 sixth control button
327 seventh control button
328 adaptor display
330 connection tab
340 connection button
351 first earphone
352 second earphone
360 earphone wire
362 battery compartment
370 adaptor microprocessor
372 adaptor battery
374 Bluetooth transceiver of the adaptor
400 music player
410 music player battery
420 music player microprocessor
430 music player storage
440 Bluetooth transceiver of the music player Referring now to FIG. 1-6, the present invention features a headband system (100) comprising a headband (200), an adaptor (300) removably attached to the headband and a music player (400).

The headband is a continuous loop with a top side (210) and a bottom side (220) along the loop circumference, wherein a curved slot (230) is disposed on the top side (210), wherein a curved protrusion (235) is disposed on the top side (210) and along the curved slot (230) outwardly, wherein the curved protrusion (235) has at least one aperture (240); wherein the headband is wearable by a user (500) around his/her forehead (510).

The adaptor (300) is removably attached to the headband (200), wherein the adapter has a main body (310) with a front side (311), back side (312), a top side (313), a bottom side (314), a first side (315) and a second side (316); wherein a connection tab (330) is disposed on bottom side (314) and extends downwardly, wherein the connection tab (330) comprises at least one button (340); wherein the connection tab (330) is configured to snugly and removably fit within the curved slot (230) of the headband (200), wherein the connection tab (330) is securely held within the curved slot (230) with the button (340) snapping to the aperture (230) on the curved protrusion (235).

The adaptor further comprises a dock (350) disposed on the front side (311), a first control button (321) and a second control button (322) disposed on the front side (311), a first earphone (351) and a second earphone (352) connecting to the main body via earphone wires (360), a battery compartment (362) disposed on the back side (312) with an adaptor battery (372) residing within the battery compartment, an adaptor microprocessor (370) and an adaptor Bluetooth transceiver (374) disposed within the main body (310). The first control button functions as a play button and the second control button functions as a pause button. The microprocessor (370) is operatively connected to the adaptor Bluetooth transceiver (374), adaptor battery (372), the first earphone (351), the second earphone (352) and the control buttons (321, 322).

The music player (400) is removably attached to the adaptor (300), wherein the music player is configured to snugly and removably fit within the dock (350), wherein the music player (400) further comprises a music player battery (410); a music player microprocessor (420), a storage (430) to store music files, a music player Bluetooth transceiver (440).

The music player microprocessor (420) is operatively connected to the music player battery (410), the storage (430) and the music player Bluetooth transceiver (440), the music player Bluetooth transceiver (440) is configured to establish a Bluetooth connection path to the adaptor Bluetooth transceiver (374). When the first control button (321) is pressed, the music player microprocessor (420) is configured to send a first signal of a music file being played to the adaptor via the Bluetooth connection path, wherein upon receiving the first signal of the music file being played, the adaptor microprocessor (370) is configured to send the first signal of the music file being played to the first earphone (351) and the second earphone 352).

The music player may be attached to the adapter directly or be placed at proximity of the adaptor to play music using the control buttons on the adaptor such that when a user is doing certain physical activity within a limited space range, such practicing on a machine, the user only needs to put the music player in an proximity place instead of putting the music player on the headband.

In some embodiments, wherein the front side (311) of the main body (310) further comprises a third control button (323), a fourth control button (324), a fifth control button (325) and a sixth control button (326), wherein the third control button (323) functions as a forward button to jump to the next music file, wherein the fourth control button (324) functions as a backward button to jump to the previous music file, wherein the fifth control button (325) functions as a volume up button, wherein the sixth control button (326) functions as a volume down button, wherein the third control button (323), the fourth control button (324), the fifth control button (325) and the sixth control button (326) are operatively connected to the adaptor microprocessor (370).

In some embodiments, the front side (311) of the main body (310) further comprises a seventh control button (327), wherein the seventh control button (327) functions as a volume mute button, wherein the seventh control button (327) is operatively connected to the adaptor microprocessor (370).

The disclosures of the following U.S. Patents are incorporated in their entirety by reference herein: (1) U.S. Pat. No. 4,682,363, (2) U.S. Pat. No. 5,438,898, (3) U.S. Patent Application Publication 2006/0185062 A1, (4) U.S. Patent Application Publication 2008/0144872 A1, (5) U.S. Patent Application Publication 2009/0208040 A1 and (6) U.S. Pat. D282020.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore. the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A headband system (100) for providing mobile music experience for a user (500), wherein the system comprising:

(a) a headband (200), wherein the headband is a continuous loop with a top side (210) and a bottom side (220) along the loop circumference, wherein a curved slot (230) is disposed on the top side (210), wherein a curved protrusion (235) is disposed on the top side (210) and along the curved of (230) outwardly, wherein the curved protrusion (235) has at least one aperture (240); wherein the headband is wearable by a user (500) around his/her forehead (510);

(b) an adaptor (300) removably attached to the headband (200), wherein the adapter has a main body (310) with a front side (311), back side (312), a top side (313), a bottom side (314), a first side (315) and a second side (316); wherein a connection tab (330) is disposed on bottom side (314) and extends downwardly, wherein the connection tab (330) comprises at least one button (340); wherein the connection tab (330) is configured to snugly and removably fit within the curved slot (230) of the headband (200), wherein the connection tab (330) is securely held within the curved slot (230) with the button (340) snapping to the aperture (230) on the curved protrusion (235), wherein the adaptor further comprises:

(i) a dock (350) disposed on the front side (311);

(ii) a first control button (321) and a second control button (322) disposed on the front side (311); wherein the first control button functions as a play button and the second control button functions as a pause button;

(iii) a first earphone (351) and a second earphone (352) connecting to the main body via earphone wires (360);

(iv) a battery compartment (362) disposed on the back side (312), wherein an adaptor battery (372) resides within the battery compartment;

(v) an adaptor microprocessor (370), an adapter Bluetooth transceiver (374) disposed within the main body (310), wherein the microprocessor (370) is operatively connected to the adaptor Bluetooth transceiver (374), adaptor battery (372), the first earphone (351), the second earphone (352) and the control buttons (321, 322);

(c) a music player (400) removably attached to the adaptor (300), wherein the music player is configured to snugly and removably fit within the dock (350), wherein the music player (400) further comprises:

(i) a music player battery (410);

(ii) a music player microprocessor (420);

(iii) a storage (430) to store music files;

(iv) a music player Bluetooth transceiver (440);

wherein the music player microprocessor (420) is operatively connected to the music player battery (410), the storage (430) and the music player Bluetooth transceiver (440); and wherein the music player Bluetooth transceiver (440) is configured to establish a Bluetooth connection path to the adaptor Bluetooth transceiver (374); wherein when the first control button (321) is pressed, the music player microprocessor (420) is configured to send a first signal of a music file being played to the adaptor via the Bluetooth connection path, wherein upon receiving the first signal of the music file being played, the adaptor microprocessor (370) is configured to send the first signal of the music file being played to the first earphone (351) and the second earphone (352).

2. The headband system (100) of claim 1, wherein at least part of the headband (200) are elastic.

3. The headband system (100) of claim 1, wherein the front side (311) of the main body (310) further comprises a third control button (323), a fourth control button (324), a fifth control button (325) and a sixth control button (326), wherein the third control button (323) functions as a forward button to jump to the next music file, wherein the fourth control button (324) functions as a backward button to jump to the previous music file, wherein the fifth control button (325) functions as a volume up button, wherein the sixth control button (326) functions as a volume down button, wherein the third control button (323), the fourth control button (324), the fifth control button (325) and the sixth control button (326) are operatively connected to the adaptor microprocessor (370).

4. The headband system (100) of claim 1, wherein the front side (311) of the main body (310) further comprises a seventh control button (327), wherein the seventh control button (327) functions as a volume mute button, wherein the seventh control button (327) is operatively connected to the adaptor microprocessor (370).

* * * * *